US010041719B2

(12) United States Patent
Gullett

(10) Patent No.: US 10,041,719 B2
(45) Date of Patent: Aug. 7, 2018

(54) WATER SUPPLY SYSTEM FOR AN ICE MAKING ASSEMBLY

(71) Applicant: General Electric Company, Schenectady, NY (US)

(72) Inventor: David Tyler Gullett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 134 days.

(21) Appl. No.: 15/092,643

(22) Filed: Apr. 7, 2016

(65) Prior Publication Data

US 2017/0292748 A1 Oct. 12, 2017

(51) Int. Cl.

| | |
|---|---|
| ***F25D 17/00*** | (2006.01) |
| ***F25D 17/06*** | (2006.01) |
| ***F25C 1/24*** | (2018.01) |
| ***F25C 1/147*** | (2018.01) |
| ***F25D 11/02*** | (2006.01) |
| ***F25D 23/04*** | (2006.01) |
| ***F25C 1/25*** | (2018.01) |

(52) U.S. Cl.

CPC ..... *F25D 17/065* (2013.01); *F25C 1/147* (2013.01); *F25C 1/24* (2013.01); *F25C 1/25* (2018.01); *F25D 11/02* (2013.01); *F25D 23/04* (2013.01); *F25C 2500/08* (2013.01); *F25C 2700/04* (2013.01); *F25C 2700/14* (2013.01)

(58) Field of Classification Search

CPC .. F25C 1/225; F25C 1/147; F25C 1/24; F25C 2500/08; F25C 2700/14; F25C 2700/04; F25D 11/02; F25D 17/065; F25D 23/04

See application file for complete search history.

(56) References Cited

U.S. PATENT DOCUMENTS

| | | | | |
|---|---|---|---|---|
| 2,858,942 | A * | 11/1958 | Wenzelberger | A23L 2/12 100/338 |
| 3,403,526 | A | 10/1968 | Brindley | |
| 7,096,686 | B2 | 8/2006 | Brunner et al. | |
| 2003/0177784 | A1 * | 9/2003 | Walton | B67D 1/0009 62/600 |
| 2004/0194481 | A1 | 10/2004 | Nomura et al. | |

FOREIGN PATENT DOCUMENTS

| | | | |
|---|---|---|---|
| JP | 2000329433 | A * | 11/2000 |
| JP | 2005037087 | A * | 2/2005 |
| KR | 101037197 | B1 | 5/2011 |

OTHER PUBLICATIONS

Yuasa, Ice Maker, Nov. 30, 2000, JP2000329433A, Whole Document.*

Irino, Drinking Water Cooler, Feb. 10, 2005, JP2005037087A, Whole Document.*

* cited by examiner

*Primary Examiner* — Larry Furdge

(74) *Attorney, Agent, or Firm* — Dority & Manning, P.A.

(57) ABSTRACT

A water switch assembly for a nugget ice making assembly is provided. The ice making assembly includes a hollow auger rotatably mounted within a reservoir and configured for extruding ice. The water switch assembly includes a water supply pipe that extends vertically through the center of the ice making auger and reservoir. The water switch assembly is in fluid communication with a water inlet and includes a capacitance probe for measuring the water level in the reservoir. In this manner, the water switch assembly is configured to control the flow of water to the reservoir in response to the water level measured by the capacitance probe.

18 Claims, 5 Drawing Sheets

WATER SUPPLY SYSTEM FOR AN ICE MAKING ASSEMBLY

FIELD OF THE INVENTION

The present subject matter relates generally to ice makers, such as nugget style ice makers, and water supply systems for the same.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate, scrape ice off an inner surface of the mold body, and force it through an extruder to form ice nuggets. Such ice makers are generally referred to as nugget style ice makers. Certain consumers prefer nugget style ice makers and their associated ice nuggets.

In certain nugget ice makers, water is supplied to the mold body from a reservoir that is remote from the mold body. Water from the remote reservoir may enter the mold body through a water inlet positioned on the mold body, e.g., commonly at the bottom of the mold body. The remote reservoir may also have a float for controlling the water level in the reservoir and in the mold body. However, because the mold body is maintained at a temperature below the freezing point of water, water entering the mold body often freezes and clogs the water inlet. A heater may be positioned near the water inlet to ensure that water entering the mold body does not freeze, but this may result in imbalanced cooling of the mold body and reduced ice maker efficiency. In addition, such a construction requires additional parts, increases cost, and prolongs assembly time. The resulting ice maker therefore has a larger footprint, requires additional components, and exhibits decreased performance and efficiency.

Accordingly, a refrigerator appliance having an ice making assembly with an improved water supply system would be useful. More particularly, a water supply system that requires fewer parts, has a smaller footprint, and exhibits improved performance and efficiency would be particularly beneficial.

BRIEF DESCRIPTION OF THE INVENTION

The present subject matter provides a water switch assembly for a nugget ice making assembly. The ice making assembly includes a hollow auger rotatably mounted within a reservoir and configured for extruding ice. The water switch assembly includes a water supply pipe that extends vertically through the center of the ice making auger and reservoir. The water switch assembly is in fluid communication with a water inlet and includes a capacitance probe for measuring the water level in the reservoir. In this manner, the water switch assembly is configured to control the flow of water to the reservoir in response to the water level measured by the capacitance probe. Additional aspects and advantages of the invention will be set forth in part in the following description, or may be apparent from the description, or may be learned through practice of the invention.

In a first exemplary embodiment, an ice making assembly that defines a vertical direction is provided. The ice making assembly includes a casing in thermal communication with a sealed system, the interior of the casing defining a reservoir configured to receive water and an auger assembly rotatably mounted within the casing. The auger assembly includes a hollow auger shaft, an auger head disposed on the auger shaft and defining an auger cavity in fluid communication with the reservoir, and a motor operably coupled with the auger shaft and configured for selectively rotating the auger assembly within the casing. The ice making assembly further includes a water switch assembly configured for controlling the water level within the auger cavity and the reservoir. The water switch assembly includes a water supply pipe having a water inlet in fluid communication with a water supply and configured to provide the auger cavity with water. The water switch assembly also includes a capacitance probe extending through the hollow auger shaft, the capacitance probe being configured to measure a water level within the auger cavity.

In a second exemplary embodiment, a water switch assembly for an ice making assembly is provided. The ice making assembly includes an auger rotatably mounted in a reservoir defined by a casing, the auger being disposed on a hollow auger shaft and defining an auger cavity in fluid communication with the reservoir. The water switch assembly includes a water supply pipe having a water inlet in fluid communication with a water supply and configured to provide the auger cavity with water. The water switch assembly also includes a capacitance probe extending through the hollow auger shaft, the capacitance probe being configured to measure a water level within the auger cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
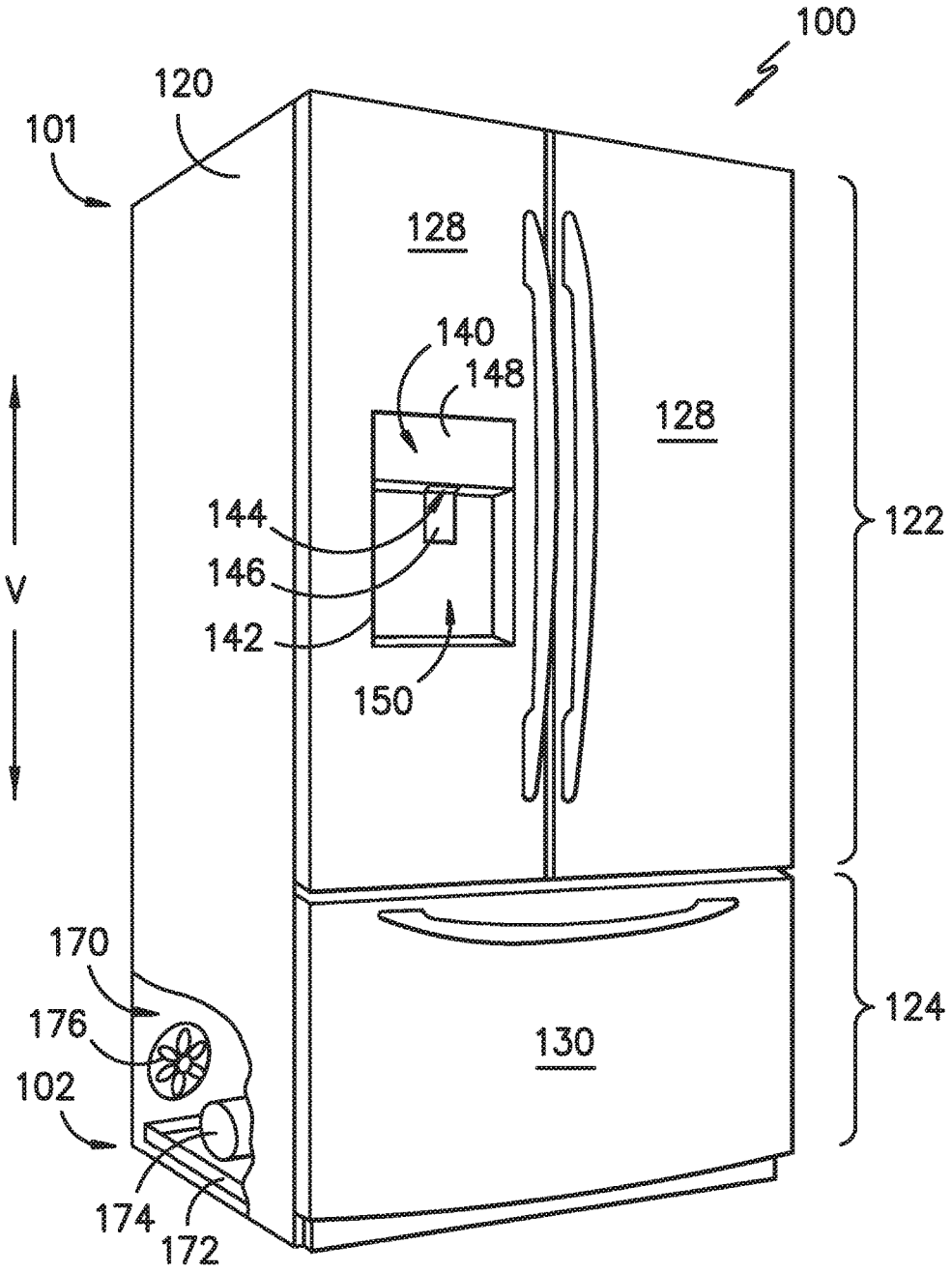
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
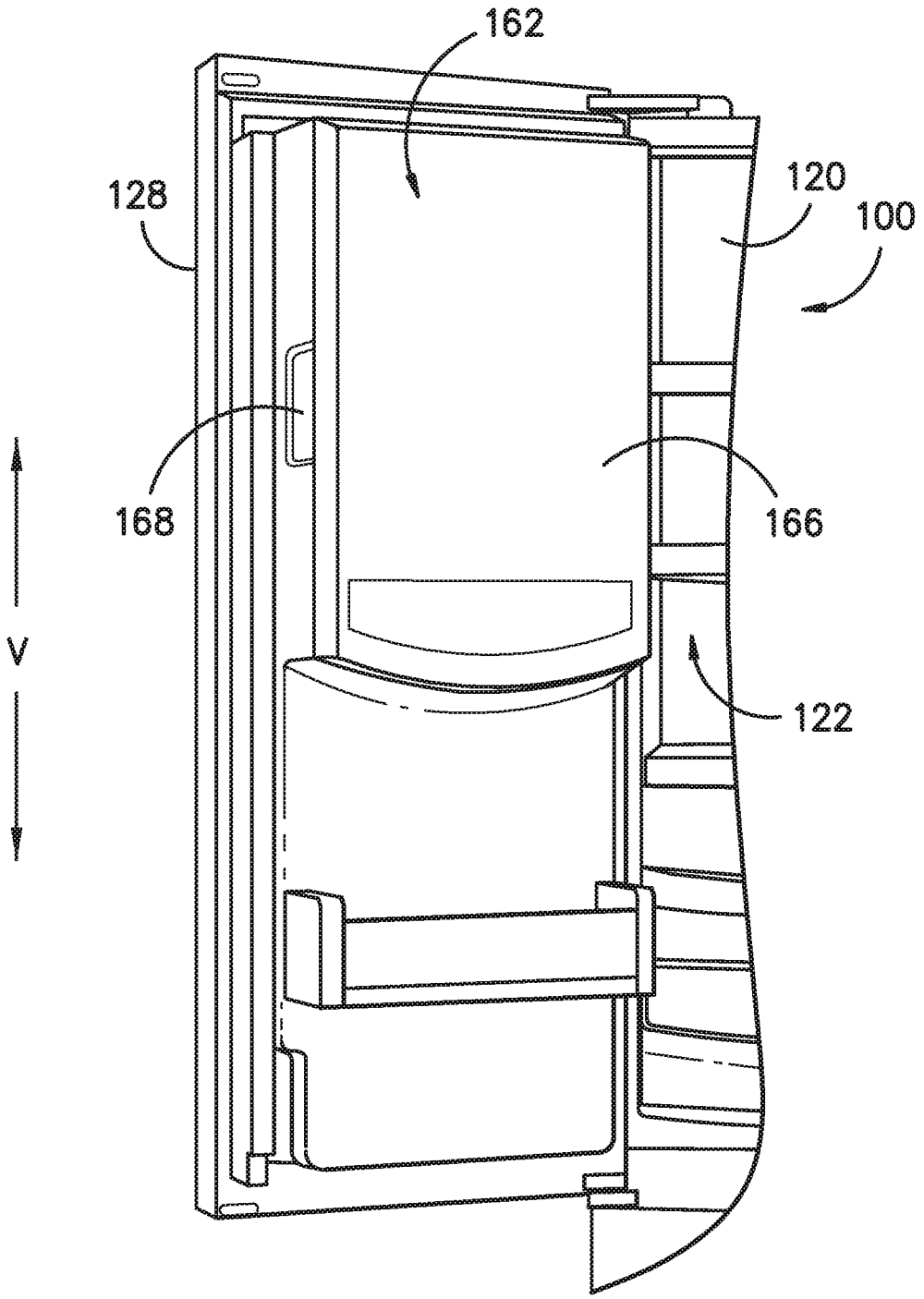
FIG. 2 provides a perspective view of a door of the exemplary refrigerator appliance of FIG. 1.
Figure 3:
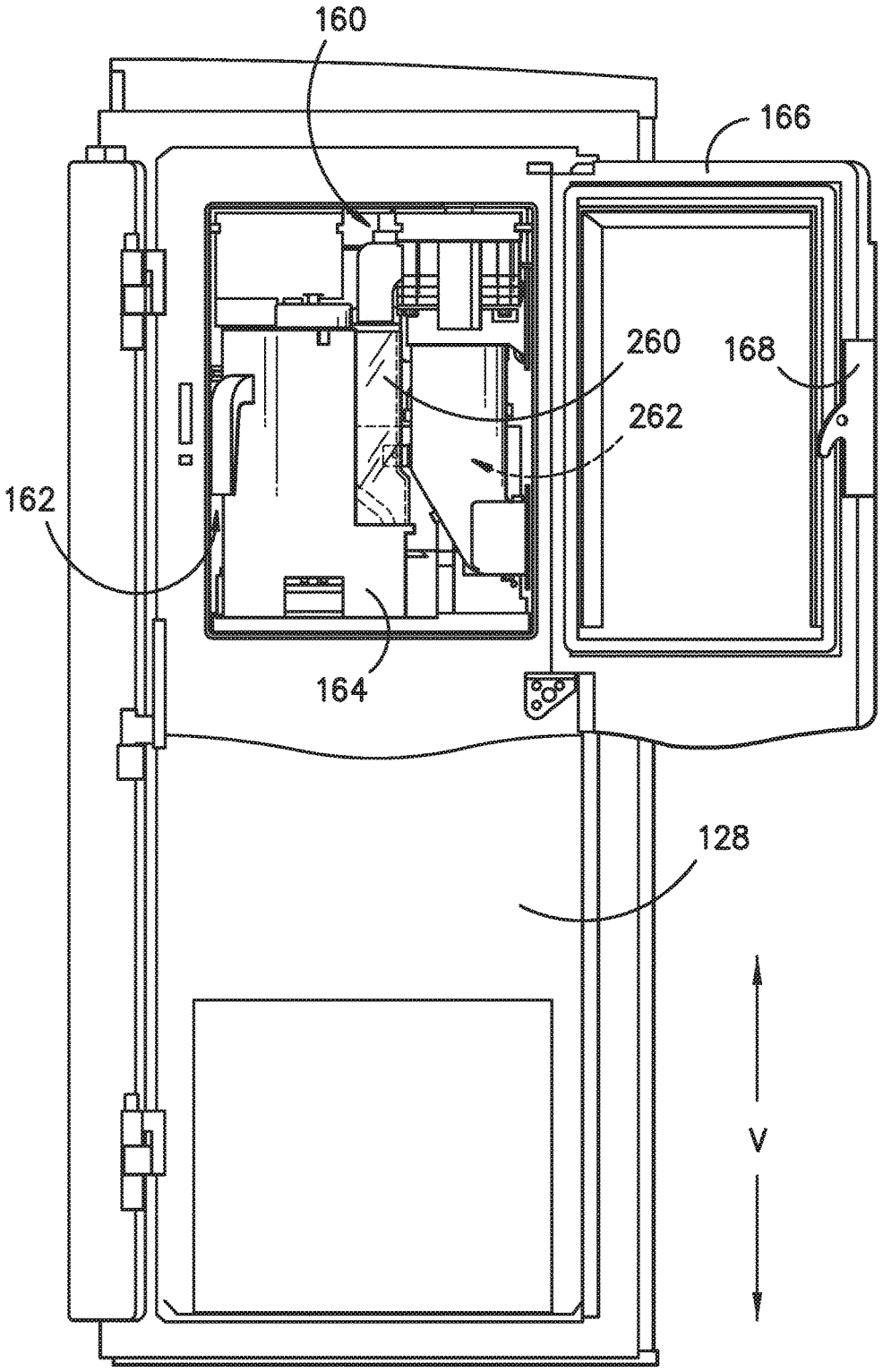
FIG. 3 provides an elevation view of the door of the exemplary refrigerator appliance of FIG. 2 with an access door of the door shown in an open position.

FIG. 2 provides a perspective view of a door of refrigerator doors 128. FIG. 3 provides an elevation view of refrigerator door 128 with an access door 166 shown in an open position. Refrigerator appliance 100 includes a freezer sub-compartment 162 defined on refrigerator door 128. Freezer sub-compartment 162 is often referred to as an "icebox." Freezer sub-compartment 162 extends into fresh food chamber 122 when refrigerator door 128 is in the closed position.

As may be seen in FIG. 3, an ice maker or ice making assembly 160 and an ice storage bin or ice bucket 164 are positioned or disposed within freezer sub-compartment 162. Thus, ice is supplied to dispenser recess 150 (FIG. 1) from the ice making assembly 160 and/or ice bucket 164 in freezer sub-compartment 162 on a back side of refrigerator door 128.

Access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162.

Chilled air from a sealed system (not shown) of refrigerator appliance 100 may be directing into ice making assembly 160 in order to cool ice making assembly 160. During operation of ice making assembly 160, chilled air from the sealed system cools components of ice making assembly 160, such as a casing or mold body of ice making assembly 160, to or below a freezing temperature of liquid water. Thus, ice making assembly 160 is an air cooled ice making assembly.

Chilled air from the sealed system also cools ice bucket 164. In particular, air around ice bucket 164 can be chilled to a temperature suitable for storing ice within sub-compartment 162. For example, cooling air may reduce the temperature within sub-compartment 162 below the freezing temperature of water. Alternatively, the temperature within sub-compartment 162 may be maintained above the freezing temperature of water, e.g., to about the temperature of fresh food chamber 122. By maintaining sub-compartment 162 at a temperature greater than the freezing temperature of water, ice nuggets stored ice bucket 164 have a reduced tendency to clump or freeze together. However, due to the temperature of ice bucket 164, ice nuggets therein can melt over time and generate liquid water in ice bucket 164.

Therefore, ice bucket 164 also includes a drain (not shown) that directs water out of ice bucket 164. In this manner, water is prevented or hindered from collecting within ice bucket 164. In addition, water generated during melting of ice nuggets may be recirculated to produce more ice or used for other purposes in refrigerator appliance 100. For example, drained water can flow out of ice bucket 164 and may be directed to an evaporation pan 172 (FIG. 1). Evaporation pan 172 is positioned within a mechanical compartment 170 defined by housing 120, e.g., at bottom portion 102 of housing 120. A condenser 174 of the sealed system can be positioned, e.g., directly, above and adjacent evaporation pan 172. Heat from condenser 174 can assist with evaporation of water in evaporation pan 172. A fan 176 configured for cooling condenser 174 can also direct a flow of air across or into evaporation pan 172. Evaporation pan 172 is sized and shaped for facilitating evaporation of liquid water therein. For example, evaporation pan 172 may be open topped and extend across about a width and/or a depth of housing 120.

Figure 4:
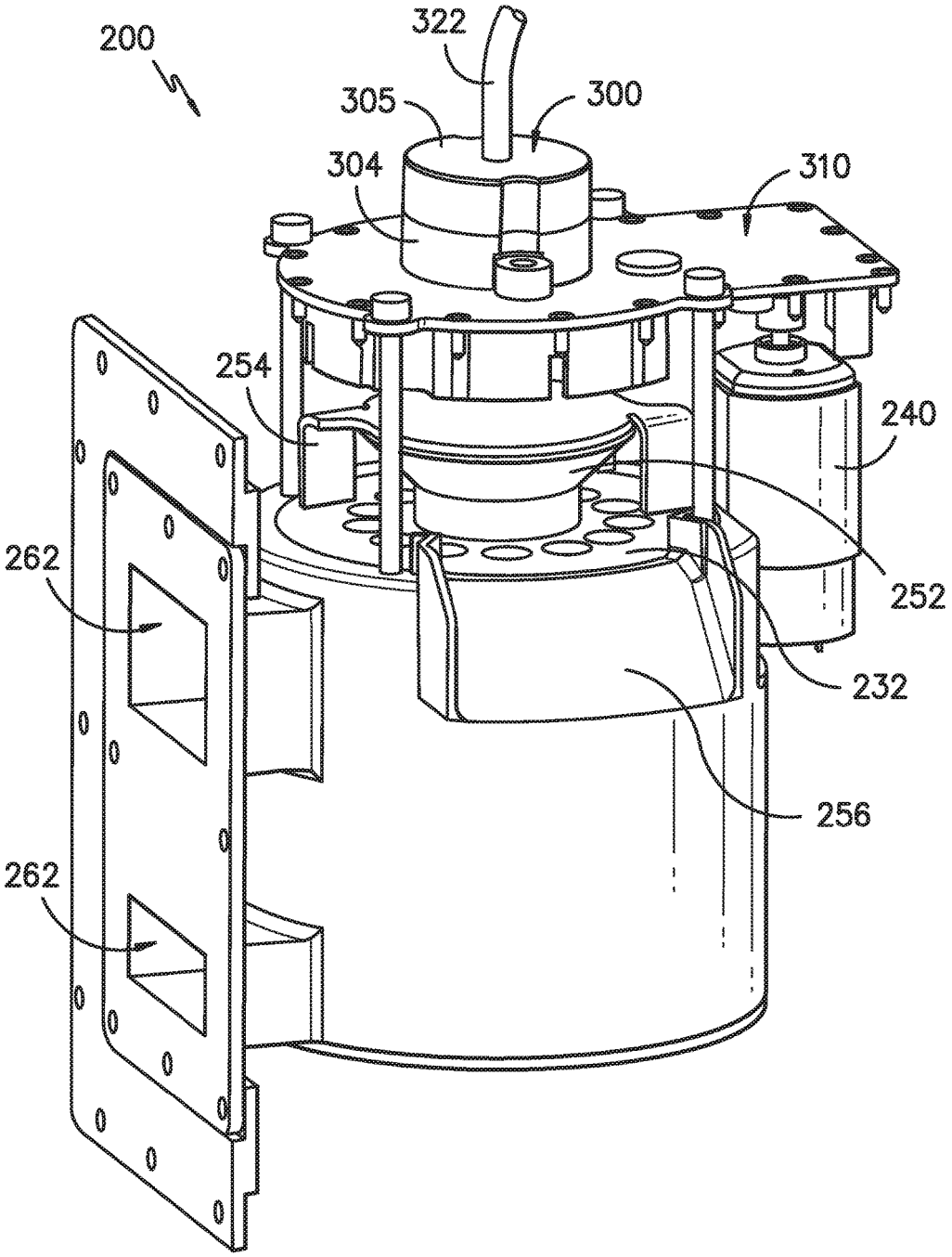
FIG. 4 provides a perspective view of an ice making assembly according to an exemplary embodiment of the present subject matter.
Figure 5:
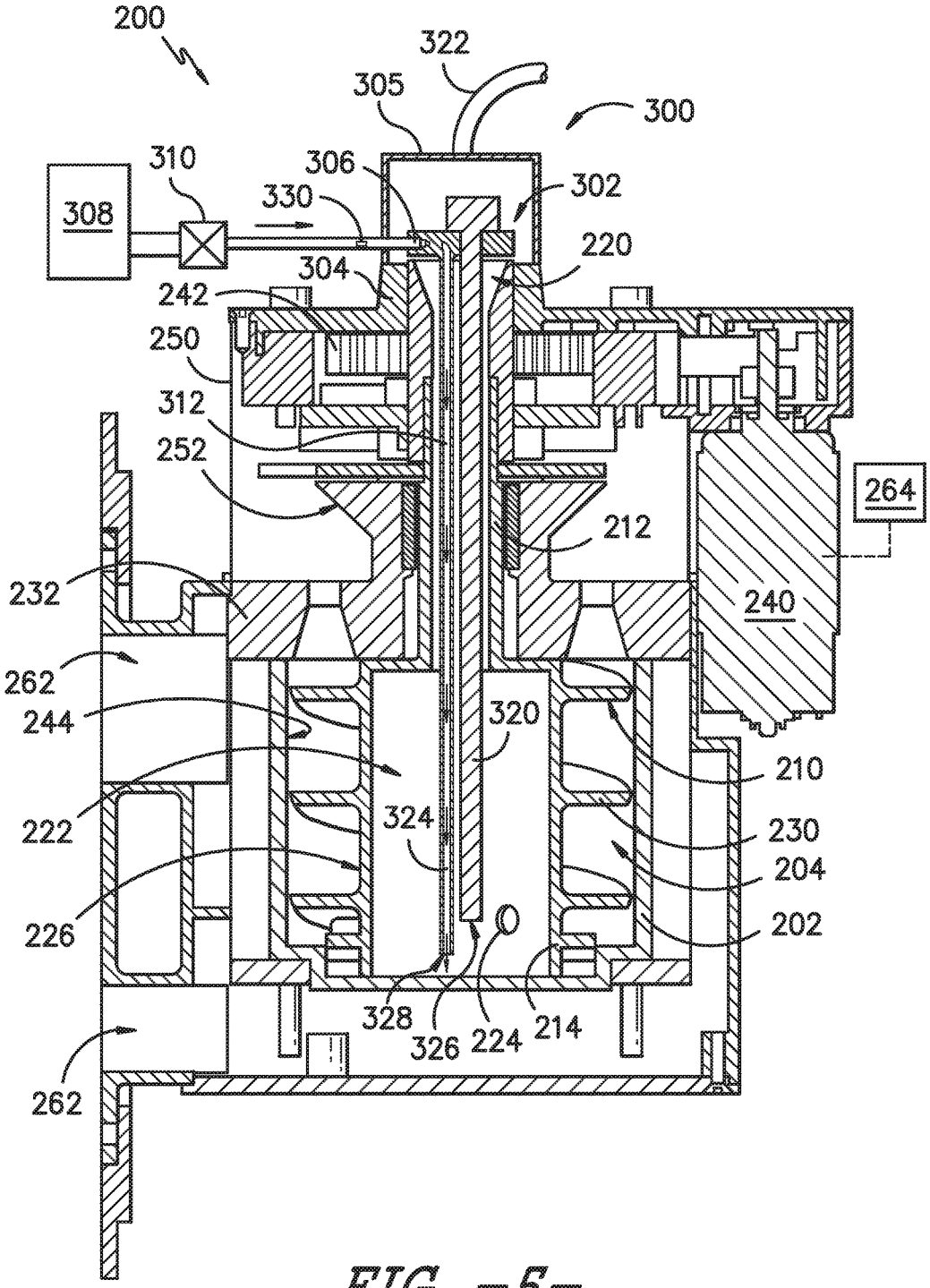
FIG. 5 provides a section view of the exemplary ice making assembly of FIG. 4, with a capacitance probe extending into the auger cavity according to an exemplary embodiment of the present subject matter.

Now referring generally to FIGS. 4 and 5, an ice making assembly 200 constructed according to an exemplary embodiment of the present subject matter will be described. FIG. 4 provides a perspective view of ice making assembly 200 and FIG. 5 provides a section view of ice making assembly 200. One skilled in the art will appreciate that ice making assembly 200 can be used in any suitable refrigerator appliance. For example, ice making assembly 200 may be used in refrigerator appliance 100 as ice making assembly 160 (FIG. 3). In addition, ice making assembly 200 is only used for the purpose of explaining certain aspects of the present subject matter. The features and configurations described may be used for other ice making assemblies as well. Other variations and modifications of the exemplary embodiment described below are possible, and such variations are contemplated as within the scope of the present subject matter.

Ice making assembly 200 includes a mold body or casing 202. Casing 202 may define a cylindrical reservoir 204 configured for receiving water. An ice making auger assembly 210 (FIG. 5) is rotatably mounted within casing 202. In particular, auger assembly 210 may include an auger shaft 212 and an auger head 214. As best shown in FIG. 5 each of auger shaft 212 and auger head 214 are hollow. More specifically, auger shaft 212 and auger head 214 may have a cylindrical shape and define an auger shaft channel 220 and an auger cavity 222.

As will be described in more detail below, water is supplied into auger cavity 222 for the purpose of ice production. Auger head 214 defines one or more apertures 224 to allow water in auger cavity 222 to flow into reservoir 204. According to an exemplary embodiment, auger head 214 defines four apertures 224. Because the pressure head in auger cavity 222 and reservoir 204 is the same, the water level in auger cavity 222 is the same as the water level in reservoir 204. Thus, as water is provided into auger cavity 222, the water level in reservoir 204 rises along with the water level in auger cavity 222.

An ice making motor 240 is mounted to casing 202 and is in mechanical communication with (e.g., coupled to) auger assembly 210. Ice making motor 240 is configured for selectively rotating auger assembly 210 within casing 202. Ice making motor 240 may be configured at any location and may directly engage auger assembly 210 or may drive auger assembly 210 through a gear assembly. For example, as shown in FIG. 5, ice making motor 240 is positioned adjacent auger assembly 210 and is parallel to auger assembly 210. Ice making motor 240 engages an auger shaft 212 through a gear assembly including drive gear 242 (other gears have been removed for clarity). Other suitable drive mechanisms for auger assembly 210 are possible and within the scope of the present subject matter.

An outer surface 226 of auger head 214 may define a continuous helical screw 230 that acts as a screw conveyor to urge ice toward an extruder 232 during operation of ice making assembly 200. Therefore, during rotation of auger assembly 210 within casing 202, auger head 214 scrapes or removes ice off an inner surface 244 of casing 202 and directs such ice to extruder 232 to form ice nuggets. More particularly, as best shown in FIG. 5, auger assembly 210 rotates to force ice, or a slurry of ice and water, upward through extruder 232. As the ice is compressed and forced upward through extruder 232, ice cylinders (not shown) are formed. The ice cylinders enter a sweep housing 250 and contact an angled wall 252. Angled wall 252 may assist in breaking the ice cylinders into ice nuggets. The ice nuggets then sit on top of extruder 232 within housing 250.

Referring now back to FIG. 4, housing 250 is removed for clarity, and a sweeper 254 is visible. Sweeper 254 is rotatably mounted within housing 250 and is configured to rotate at a very low speed, e.g., one revolution per minute (RPM). More specifically, sweeper 254 may be in mechanical communication with ice making motor 240, e.g., via a gear assembly. The ice making motor 240 can selectively rotate sweeper 254 within sweep housing 250, and thereby assist with dispensing or removing ice nuggets from sweep housing 250.

Rotation of the sweeper 254 within sweep housing 250 moves the ice nuggets through an opening in housing 250 that is adjacent an ice chute 256. As best shown in FIG. 4, ice chute 256 is sized for directing ice nuggets out of sweep housing 250. In this manner, the ice nuggets exit sweep housing 250, slide down ice chute 256, and are dispensed into ice bucket 164. According to alternative embodiments, ice making assembly 200 may further include an ice nugget conduit instead of, or in addition to, ice chute 256. Moreover, other suitable means for collecting and storing extruded ice are contemplated and within the scope of the present subject matter. From ice bucket 164, the ice nuggets can enter dispensing assembly 140 (FIG. 1) and be accessed by a user as discussed above. In such a manner, ice making assembly 200 can produce or generate ice nuggets.

Ice making assembly 200 and its components may be constructed in any suitable manner and from any suitably rigid material or materials. For example, ice bucket 164 may be constructed with a single molded material, e.g., plastic. In addition, ice bucket 164 may be constructed of multiple components including a window 260 (FIG. 3) that permits a user of ice bucket 164 to view its storage volume. Casing 202, extruder 232, and sweeper 254 are typically constructed from a suitable metal, such as steel. Auger assembly 210 may be constructed from any suitably rigid material, such as plastic or steel. In addition, auger assembly 210 may be constructed as a single, unitary component, or may be an assembly of multiple parts. Sweep housing 250 may be constructed of plastic. However, according to alternative embodiments, each component may be constructed of any suitably rigid material.

According to an alternative exemplary embodiment, ice making assembly may include a fan (not shown) configured for directing a flow of chilled air through a housing or duct 262 towards casing 202. As an example, the fan can direct chilled air from an evaporator of a sealed system through duct 262 to casing 202. Thus, casing 202 can be cooled with chilled air from the fan such that ice making assembly 200 is air cooled in order to form ice therein. According to some exemplary embodiments, ice making assembly 200 may also include a heater (not shown), such as an electric resistance heating element, mounted to casing 202. The heater may be configured for selectively heating casing 202, e.g., when ice prevents or hinders rotation of auger assembly 210 within casing 202.

Operation of ice making assembly 200 is controlled by a processing device or controller 264, e.g., that may be operatively coupled to control panel 148 for user manipulation to select features and operations of ice making assembly 200. Controller 264 can operate various components of ice making assembly 200 to execute selected system cycles and features. For example, controller 264 is in operative communication with ice making motor 240 and other components of ice making assembly 200. Thus, controller 264 can selectively activate and operate ice making motor 240 during the ice making process.

Controller 264 may include a memory and microprocessor, such as a general or special purpose microprocessor operable to execute programming instructions or microcontrol code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 264 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Ice making motor 240 may be in communication with controller 264 via one or more signal lines or shared communication busses.

Ice making assembly 200 may also include one or more temperature sensors (not shown). For example, temperature sensors may be configured for measuring a temperature of casing 202 and/or liquids, such as liquid water, within casing 202. Such temperature sensors may be any suitable device for measuring the temperature of components of ice making assembly 200 or liquids therein. For example, the temperature sensors may be thermistors or thermocouples. Controller 264 can receive a signal, such as a voltage or a current, from the temperature sensors that correspond to the temperature of the temperature of casing 202 and/or liquids therein. In such a manner, the temperature of casing 202 and/or liquids therein can be monitored and/or recorded with controller 264.

Referring now specifically to FIG. 5, a water switch assembly 300 for controlling the level of water within reservoir 204 and auger cavity 222 will be described. Water switch assembly 300 may include a switch head assembly 302 that is mounted to a boss 304 defined on the top side of sweep housing 250. According to the illustrated embodiment, a protective cap 205 is positioned over switch head assembly 302. As shown, switch head assembly 302 may define a water inlet 306 that is in fluid communication with a water supply 308. A valve 310 is positioned between water supply 308 and water inlet 306 to regulate to flow of supply water into switch head assembly 302. Water inlet 306 is also in fluid communication with a water supply pipe 312 that is configured for delivering supply water through auger shaft 212 and into auger cavity 222. According to the illustrated exemplary embodiment, valve 310 may be positioned in or proximate to water inlet 306 and may be configured to open and close water inlet 306 as needed to supply or stop the flow of water into water supply pipe 312.

According to the illustrated embodiment, a capacitance probe 320 extends through switch head assembly 302, down auger shaft 212 and into the center of auger cavity 222. Capacitance probe 320 may be used to continuously monitor the water level in reservoir 204 of auger style ice making assembly 200. In general, capacitance probe 320 may be a capacitive water level sensor or any other suitable water level sensor using capacitance-based measurements, as is known in the art. Capacitance probe 320 includes an elongated shaft that extends through auger shaft 212 and into auger cavity 222. As one skilled in the art will appreciate, the voltage generated by capacitance probe 320 varies approximately linearly with the water level. Capacitance probe 320 and valve 310 may be in operable communication with controller 264, e.g., via control wires 322 or any other suitable electrical connection. In this manner, controller 264 may receive instantaneous and continuous feedback regarding the water level within reservoir 204 and make control inputs for optimum performance of ice making assembly 200 based on that feedback, as described below.

Notably, water supply pipe 312 and capacitance probe 320 extend through drive gear 242, but are not coupled to drive gear 242. In this manner, ice making motor 240 may rotate drive gear 242 and auger assembly 210 without affecting the operation of water supply pipe 312 and capacitance probe 320. In addition, water supply pipe 312 and capacitance probe 320 are substantially concentrically disposed within auger cavity 222. In this manner, they are positioned at the warmest location within reservoir 204—i.e., the furthest away from casing 202 where ice is formed. In this manner, the potential for water supply pipe 312 freezing or ice forming on capacitance probe 320 is minimized or eliminated.

Notably, as supply water flows through water supply pipe 312 into auger cavity 222, it may have the tendency to flow over capacitance probe 320, resulting in inaccurate water level measurements. Particularly when water supply pipe 312 is short and does not extend all the way through auger shaft 212 and into auger cavity 222, erroneous water level measurements will likely result. Therefore, according to the exemplary embodiment illustrated in FIG. 5, water switch assembly 300 further includes a dip tube 324, which is essentially an extension of water supply pipe 312. According to the illustrated exemplary embodiment, dip tube 324 extends all the way into auger cavity 222 and below a bottom end 326 of capacitance probe 320. Dip tube 324 has a water outlet 328 at its distal end, such that water is introduced into auger cavity 222 near the bottom of auger assembly 210 and below capacitance probe 320. In this manner, erroneous measurements resulting from the water inadvertently contacting capacitance probe 320 may be reduced or eliminated altogether.

During operation, water switch assembly 300 maintains the water level in reservoir 204 at a desired level for optimum performance of ice making assembly 200. More particularly, according to an exemplary embodiment, water switch assembly 300 may be configured to open valve 310 when the water level in reservoir 204 drops below a predetermined lower threshold. When this occurs, water enters water inlet 306 from water supply 308 and enters auger cavity 222 through water supply pipe 312. In addition, when the water level in reservoir 204 rises to a predetermined maximum threshold, controller 264 may shut off valve 310 and stop water from flowing into water inlet 306 and auger cavity 222.

According to the illustrated exemplary embodiment, controller 264 may operate valve 310 to regulate the water level in reservoir 204 to be substantially equivalent to or to track a target water level. The target water level may be fixed or may vary depending on a variety of conditions, including, e.g., the user settings, the temperature of supply water, the ice production rate, and the water level as measured by capacitance probe 320. Valve 310 may be regulated to continuously refresh the water in reservoir to match the target level, e.g., to replenish water volume lost as ice is scraped from the walls of casing 202 and discharged from ice making assembly 200.

According to an exemplary embodiment of the present subject matter, water switch assembly 300 may be configured to operate valve 310 such that the water level in reservoir 204 tracks a target water level that is dependent on the temperature of the supply water from water supply 308. For example, a temperature sensor 330 may be positioned at water supply 308, in water inlet 306, or in water supply pipe 312. Temperature sensor 330 may be any suitable device for measuring the temperature of water received by ice making assembly 200. For example, temperature sensor 330 may be a thermistor or thermocouple. Controller 264 can receive a signal, such as a voltage or a current, from temperature sensor 330 that corresponds to the measured temperature. By monitoring and controlling the water level inside reservoir 204, ice making assembly 200 can compensate for situations where the ice production rate is slowed by, e.g., higher than average supply water temperatures, as described below.

As explained above, the ice making region of ice making assembly 200 is along the walls of casing 202 (i.e., the heat exchanger). Notably, the heat exchange rate is proportional to the heat exchange area. Therefore, adjusting the water level inside reservoir 204 will directly affect the heat exchange rate by changing the contact area between water and the scraped surface of casing 202. More specifically, lowering the water level will decrease the surface area of water contacting casing 202 and therefore decrease the rate of heat exchange required to freeze water and make ice. Higher inlet water temperatures will require more heat to be removed from the water to make ice, and therefore, increasing inlet water temperature will require lowering the heat exchange area to maintain constant rate of heat transfer for a given volume of water. Thus, water levels in reservoir 204 can be optimized to achieve a desirable ice production rate for various inlet water temperatures.

For example, during normal operation of ice making assembly 200, the water supply temperatures may vary significantly (e.g., up to 40 degrees Fahrenheit), resulting in adverse effects on the rate of ice production of ice making assembly 200. If ice making assembly 200 is making ice where the supply water is warm, more time will be required to remove heat from that water volume to produce ice. To compensate for this excess heat energy, ice making assembly 200 may decrease the water level in reservoir 204, thereby reducing the total amount of heat energy that must be transferred and speeding up ice production.

By contrast, if ice making assembly 200 is making ice where the supply water is cold, less time will be required to remove heat from that water volume to produce ice. To reduce the possibility of forming too much ice, jamming auger assembly 210, or to otherwise compensate for the cold water, ice making assembly 200 may increase the water level in reservoir 204. By increasing the water level, the total amount of heat energy that must be removed will be increased, thereby slowing the rate of ice production.

Notably, water level adjustments may be continuously implemented if needed based on the temperature of the supply water at water inlet 306 (as sensed by temperature sensor 330) and the current water level in reservoir 204 (as measured by capacitance probe 320). Controller 264 may continuously monitor the temperature of supply water and the water level in reservoir 204, and may regulate valve 310 to ensure optimal ice production is achieved.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly that defines a vertical direction, comprising:

a casing in thermal communication with a sealed system, the interior of the casing defining a reservoir configured to receive water;

an auger assembly rotatably mounted within the casing, the auger assembly comprising:

a hollow auger shaft;

an auger head disposed on the auger shaft and defining an auger cavity in fluid communication with the reservoir; and a motor operably coupled with the auger shaft and configured for selectively rotating the auger assembly within the casing; and a water switch assembly configured for controlling the water level within the auger cavity and the reservoir, the water switch assembly comprising:

a water supply pipe having a water inlet in fluid communication with a water supply and a dip tube that extends from the water inlet at a top of the auger cavity through the auger cavity to a water outlet positioned proximate a bottom of the auger cavity, the water supply pipe being configured to provide the auger cavity with water; and a capacitance probe extending through the hollow auger shaft, the capacitance probe being configured to measure a water level within the auger cavity.

2. The ice making assembly of claim 1, further comprising a valve that is selectively operated to provide supply water from the water supply to the auger cavity responsive to the measured water level.

3. The ice making assembly of claim 2, wherein the valve opens to supply water to the auger cavity when the measured water level falls below a predetermined lower threshold and closes when the measured water level rises above a predetermined upper threshold.

4. The ice making assembly of claim 2, wherein the valve is operated to regulate the water level within the auger cavity such that the measured water level is equivalent to a target water level.

5. The ice making assembly of claim 4, wherein the target water level is adjusted based on a temperature of supply water.

6. The ice making assembly of claim 4, wherein the water switch assembly further comprises a temperature sensor configured for measuring the temperature of supply water at the water inlet, and wherein the target water level is adjusted based on the temperature of water at the water inlet.

7. The ice making assembly of claim 4, wherein the target water level is adjusted based on an ice production rate of the ice making assembly.

8. The ice making assembly of claim 1, wherein the dip tube extends below a bottom end of the capacitance probe, such that the water outlet of the dip tube is positioned below the capacitance probe along the vertical direction.

9. The ice making assembly of claim 1, wherein the auger assembly further comprises a drive gear operably coupling the auger shaft with the motor, and wherein the capacitance probe and the water supply pipe pass through a center of the drive gear.

10. The ice making assembly of claim 1, wherein the auger head defines a plurality of apertures to provide fluid communication between the auger cavity and the reservoir.

11. A water switch assembly for an ice making assembly, the ice making assembly comprising an auger rotatably mounted in a reservoir defined by a casing, the auger being disposed on a hollow auger shaft and defining an auger cavity in fluid communication with the reservoir, the water switch assembly comprising:

a water supply pipe having a water inlet in fluid communication with a water supply and a dip tube that extends from the water inlet at a top of the auger cavity through the auger cavity to a water outlet positioned proximate a bottom of the auger cavity, the water supply pipe being configured to provide the auger cavity with water; and a capacitance probe extending through the hollow auger shaft, the capacitance probe being configured to measure a water level within the auger cavity.

12. The water switch assembly of claim 11, further comprising a valve that is selectively operated to provide supply water from the water supply to the auger cavity responsive to the measured water level.

13. The water switch assembly of claim 12, wherein the valve opens to supply water to the auger cavity when the measured water level falls below a predetermined lower threshold and closes when the measured water level rises above a predetermined upper threshold.

14. The water switch assembly of claim 12, wherein the valve is operated to regulate the water level within the auger cavity such that the measured water level is equivalent to a target water level.

15. The water switch assembly of claim 14, wherein the water switch assembly further comprises a temperature sensor configured for measuring the temperature of supply water at the water inlet, and wherein the target water level is adjusted based on the temperature of supply water measured at the water inlet.

16. The water switch assembly of claim 14, wherein the target water level is adjusted based on an ice production rate of the ice making assembly.

17. The water switch assembly of claim 11, wherein the dip tube extends below a bottom end of the capacitance probe, such that the water outlet of the dip tube is positioned below the capacitance probe along a vertical direction.

18. The water switch assembly of claim 11, wherein the auger defines a plurality of apertures to provide fluid communication between the auger cavity and the reservoir.

* * * * *